US012137760B2

(12) United States Patent
Boss

(10) Patent No.: US 12,137,760 B2
(45) Date of Patent: Nov. 12, 2024

(54) GLOVE WITH LACING SYSTEM

(71) Applicant: LEKISPORT AG, Baar (CH)

(72) Inventor: Matthias Boss, Baar (CH)

(73) Assignee: LEKISPORT AG, Baar (CH)

( * ) Notice: Subject to any disclaimer, the term of this patent is extended or adjusted under 35 U.S.C. 154(b) by 958 days.

(21) Appl. No.: 16/962,636

(22) PCT Filed: Dec. 13, 2018

(86) PCT No.: PCT/EP2018/084722
§ 371 (c)(1),
(2) Date: Jul. 16, 2020

(87) PCT Pub. No.: WO2019/141446
PCT Pub. Date: Jul. 25, 2019

(65) Prior Publication Data

US 2020/0345089 A1 Nov. 5, 2020

(30) Foreign Application Priority Data

Jan. 19, 2018 (CH) ..... 00060/18

(51) Int. Cl.
*A41D 19/00* (2006.01)
*A45B 9/02* (2006.01)
*A63C 11/22* (2006.01)

(52) U.S. Cl.
CPC ..... *A41D 19/0037* (2013.01); *A45B 9/02* (2013.01); *A41D 2600/10* (2013.01); *A45B 2009/025* (2013.01); *A45B 2200/055* (2013.01); *A63C 11/222* (2013.01)

(58) Field of Classification Search
CPC ..... A41D 19/0037; A41D 2600/10; A41D 19/0048; A45B 9/02; A45B 2009/025; A63C 11/222
See application file for complete search history.

(56) References Cited

U.S. PATENT DOCUMENTS 3,147,526 A * 9/1964 Winson ..... A41F 1/06 24/713.6
5,042,177 A * 8/1991 Schoch ..... A43C 11/165 36/50.1
5,328,205 A 7/1994 Bacharach
5,367,712 A * 11/1994 Smith ..... A41D 19/015 2/161.1

(Continued)

FOREIGN PATENT DOCUMENTS

CH 699 880 A2 5/2010
EP 0 919 147 A2 6/1999

(Continued)

OTHER PUBLICATIONS

International Search Report for PCT/EP2018/084722, dated Feb. 4, 2019.

*Primary Examiner* — Sally Haden
(74) *Attorney, Agent, or Firm* — Sughrue Mion, PLLC

(57) ABSTRACT

The invention relates to a size-adjustable glove (1) which has a thumb covering (4) and at least one first finger covering (5) that has a coupling element (25) in a saddle region between the thumb covering and the first finger covering, said coupling element being suitable for releasably securing the glove to a coupling device of a pole grip.

19 Claims, 9 Drawing Sheets

(56) References Cited

U.S. PATENT DOCUMENTS

| | | | | |
|---|---|---|---|---|
| 5,887,282 | A * | 3/1999 | Lenhart ..... | A63C 11/2228<br>2/160 |
| 9,375,053 | B2 | 6/2016 | Burns et al. | |
| 2013/0269219 | A1 | 10/2013 | Burns et al. | |
| 2017/0165557 | A1 | 6/2017 | McPhail et al. | |

FOREIGN PATENT DOCUMENTS

| | | | |
|---|---|---|---|
| EP | 1 072 202 | A2 | 1/2001 |
| EP | 1 827 150 | A1 | 9/2007 |
| EP | 1 827 623 | A1 | 9/2007 |
| EP | 2 805 639 | A1 | 11/2014 |
| WO | 94/07384 | A1 | 4/1994 |
| WO | 2006/066423 | A1 | 6/2006 |

* cited by examiner

GLOVE WITH LACING SYSTEM

CROSS REFERENCE TO RELATED APPLICATIONS

This application is a National Stage of International Application No. PCT/EP2018/084722 filed Dec. 13, 2018, claiming priority based on Switzerland Patent Application No. 00060/18 filed Jan. 19, 2018.

TECHNICAL FIELD

The present invention relates to a glove, in particular for users of poles for the sport disciplines of skiing, hiking and walking, in particular for users of walking sticks, trekking poles, Alpine ski poles, cross-country ski poles, or Nordic walking poles. The glove in terms of the fit or width thereof, respectively, is designed so as to be adjustable by a lacing system or tensioning system, respectively. The present invention thus relates to a glove which may also be an adjustable hand strap which is fastenable to the hand and which has a separate thumb opening and a further opening for the other fingers and which collaborates with a pole handle, wherein the pole handle possesses a handle member having a coupling device for fastening the glove.

PRIOR ART

Pile-and-loop fasteners or elastic bands are often used for constricting the wrist opening of a glove so as to prevent the ingress of dirt, snow, moisture and cold and so as to better fasten the glove to the hand. Simple lacing systems for gloves are known from boxing, for example. Improved lacing systems for constricting the width of worn gloves are known in the prior art, thus for example from EP-A-1 072 202 or CH-A-699 880. In EP-A-1 072 202 the constriction of the hand opening is achieved by contracting an upper and a lower support element in the manner of clamping jaws. The free ends of the tension bands herein are guided by a common clamping element. CH-A-699 880 discloses a glove with two shells, wherein the external skin is interrupted. and the gap is bridged by a zig-zag profile of a pull cord and is configured so as to be adjustable for width.

A glove having an integrated hand strap for poles such as ski poles, cross-country poles, trekking poles, or hiking poles is known from EP-A-0 919 147, wherein the hand strap which is fastenable to a pole handle is provided with a strap part which encloses the wrist and is adjustable in terms of circumference, with a connector part which runs on the inside of the glove in the region of the thumb joint, and a traction element for the strap part to the pole handle which runs on. the outside of the glove, and with a connection element which projects from the glove for the preferably releasable fastening to the pole handle and which is fixedly connected to the connector part and to the traction element and is disposed between the thumb part and the index finger part or the mitten part of the glove. In order to thus achieve not only a secure grip on a ski pole that serves for the direct transmission of force, but to also enable the ski pole to be encompassed and allow said ski pole to captively hang on the glove, it is provided that the connector part and the traction. element are disposed so as to lie freely along the glove surface and that the traction element is at least in part elastically configured and is releasably fastened on the external side of the glove.

In order for the handling of the lacing system to be facilitated, lacing systems with a tensioning system. can be used, such as are proposed in EP-A-2 805 639 A1 or US-A-2013/0269219, for example.

A glove for coupling to a pole handle having a hook-type device is known from EP-A-1 827 150, for example. Such a glove which is coupled to a pole handle is exposed to a heavy tensile load while engaging in the sports discipline, in particular by virtue of the constant movement of the pole and of the influence of force when supported on the pole. On account thereof, deformations of the glove can arise, or even irreversible elongations of the material or in the worst case even tearing of the external skin of the glove in the event of excessive stress.

A glove in which the fit around a hand. inserted. into said glove is to be improved is known from WO-A-9407384. The glove has a fit adjustment mechanism which by way of an adjustment cable element which has a variable effective length is attached to one or a plurality of adjustments strips. The adjustment strip, or the adjustments strips, at all times extend so as to encircle the base of the glove. When the adjustment mechanism is rotated, the effective length of the cable element is shortened, this causing the closed loop of the strip and of the cable element to contract around the hand inserted in the glove. The fit of the glove around the hand is improved on account thereof.

Disclosure of the Invention

The invention is thus based on the object to make available a glove which is improved in comparison to the prior art, including the situation when said glove is configured as an adjustable hand strap which is fastenable to the hand and which has in particular three openings, one separate thumb opening and one further opening for the other fingers. This is in particular an improvement of a glove suitable for coupling to a walking stick, a trekking pole, an Alpine ski pole, a cross-country pole, or a Nordic walking pole, having a coupling device, in particular a hook-type device, for fastening the glove. The glove herein has a coupling element which is releasably fastenable to the coupling device of the pole handle and which is fixed in a self-latching manner to the coupling device.

This object is achieved in that the glove, wherein this may also be understood to be a hand strap of the type mentioned at the outset, moreover has a system for setting the width of the worn glove, said system preferably being coupled to the anchoring, or the fastening, respectively, of the coupling device, preferably in that the system for setting the width of the worn glove is connected to the coupling element by way of at least one material portion of low elongation or even zero elongation.

The invention thus comprises a glove (including a hand strap of the type mentioned at the outset) which is able to be coupled to a pole handle, or is releasably fastenable to the latter, respectively, the width of said worn glove being able to be selectively set. The glove according to the invention has a thumb covering for receiving the thumb of the user, as well as at least one first finger covering for receiving at least one finger.

When the glove is configured in the form of a hand strap, the thumb covering in this instance is an exit opening for the thumb, and the finger covering is an exit opening for the at least one finger, or for all remaining four fingers. A hand strap according to the invention as a glove thus has three openings, specifically a first opening for the wrist, a second opening for the thumb, and a third opening for at least one of the remaining four fingers, preferably for all remaining four fingers.

In somewhat other words, the invention thus relates to a glove in the form of a hand-holding device, or understood to be a hand-holding device, having a thumb covering and at least one first finger covering which in the case of a hand strap can be configured as a first exit opening for a thumb and a second exit opening for remaining fingers, respectively, said glove in a saddle region between the thumb covering and the first finger covering, or between the first exit opening for the thumb and the second exit opening for the remaining fingers, respectively, possessing a coupling element which is configured for releasably fastening the glove in the sense of a hand-holding device to a coupling device of a pole handle, characterized in that the glove in the sense of the hand-holding device has a lacing system for selectively setting a width of the worn glove in the sense of the hand-holding device. When mention is made of a glove hereunder, this also includes the preferred embodiment of the configuration of the glove as a hand strap, unless otherwise explicitly stated.

A first preferred embodiment relates to a finger glove, in particular for the Alpine skiing sport and for skiing tours. The finger glove herein has a thumb covering, as well as a first finger covering, and preferably also a second, third, and a fourth finger covering for receiving the index finger, the middle finger, the ring finger, and the little finger, respectively.

As an alternative to a finger glove, the invention can also relate to a mitten, that is to say to a glove which has only a thumb covering and a single finger covering for receiving the remaining four fingers. In the case of said mitten, the first and single finger covering is already equipped so as to be wide enough to receive the remaining four fingers with the exception of the thumb. A further variant has a thumb covering as well as an index finger covering and a further finger covering for receiving the remaining three fingers. A further embodiment of the glove in the sense of the hand-holding device is configured as a hand strap which as a thumb covering has an exit opening for the thumb, and as at least one finger covering has an exit opening for the at least one finger or for all remaining four fingers. A hand strap according to the invention thus has three openings, specifically a first opening for the wrist, a second opening for the thumb, and a third opening for at least one of the remaining four fingers, preferably for all remaining four fingers.

Independently thereof, the glove according to the invention, between the thumb covering and the first finger covering, or when configured as a hand strap between the exit hole for the thumb and the exit hole for the remaining four fingers, has a saddle region which possesses a coupling element, for example a device in the shape of a strap, ring, or eyelets, preferably in the form of a movable strap. The strap herein is preferably fastened to the hand-holding device in such a manner that said strap by way of the residual inherent stiffness thereof projects between the thumb and the index finger of the user in such a manner that said strap can be easily pushed over the hook-type device. The strap is preferably a strap from a flexible material which has a sufficient inherent stiffness such that said material is stabilized in a position in the space between the thumb and the index finger which enables a simple introduction over the nook, or the holding pin, respectively, and which material when in use is not or barely perceivable, on the other hand. Straps made from cables or wire which may optionally be coated on the surface are possible. In principle, other elements such as, for example, low-elongation textile fibers which are stable under tension and are sheathed with a tubular fabric, or holding elements which are braided in the manner of laces or ropes, respectively, using corresponding materials such as, for example, aramid, Keviar, Dyneema, etc. are also suitable as the material for such straps. When such materials are used for the strap, laces having a thickness of 1 mm to 5 mm, wherein a thickness of 2 mm to 3 mm is preferable, are best suitable. In order for the strap to be imparted sufficient inherent stiffness, laces of this type can be provided with reinforcement elements such as, for example, a core of monofilament nylon or fibers from a stiffer material such as, for example, nylon or thin metal wires, said fibers being incorporated in such laces by braiding. It has been demonstrated that a cable having a thickness in the range from 0.5 mm to 2.5 mm, preferably in the range from 1 mm to 2 mm, is particularly suitable.

The coupling element is suitable for releasably fastening the glove (as an actual glove or as a hand strap) to a corresponding device of a pole handle. Such a pole handle can be configured as is illustrated in EP 1 627 623, for example. In the case of a movable strap, said movable strap is pushed over a hook-type device of the pole handle and preferably latches thereon. However, other coupling devices, such as for example a tongue-type coupling device on the glove (as an actual glove or as a hand strap) which is able to be introduced in a recess which is provided therefor on the pole handle and is fastened there in a self-latching and releasable manner, are also possible.

The glove according to the invention (as an actual glove or as a hand strap), independently of the type of the coupling element, additionally has a lacing system for selectively setting a width of the worn glove, preferably of the worn hand strap. The lacing system is preferably disposed on a glove upper side which covers the hand dorsum of the user (upper side or hand dorsum side of the hand strap, when the glove is configured as a hand strap), and herein preferably in a hand dorsum region between a wrist region and a beginning of the first finger covering, or the finger coverings, or the exit opening for the fingers, respectively.

The lacing system is preferably a tensioning system. Said tensioning system preferably has a tensioning element, preferably having a tensioning wheel, a tensioner housing, and a coil received in the tensioner housing, such as is disclosed in U.S. Pat. No. 9,375,053 or EP 2 805 639, for example.

A preferred lacing system moreover has a tensioning lace which is guided through at least one recess or at least one guide strap, wherein an activation of the tensioning element, in particular by rotating the tensioning wheel in a tensioning direction, tensions the tensioning lace in a tensioning region, and the width or the fit, respectively, of the worn glove (as an actual glove or as a hand strap) is thus decreased in particular in the wrist region and/or the hand dorsum region, and wherein an activation of the tensioning element, preferably by rotating the tensioning wheel in the relaxing direction counter to the tensioning direction, preferably relaxes or releases the tensioning lace, and the width of the worn glove (as an actual glove or as a hand strap) is thus increased, this herein being either continuous or in steps. The length of the tensioning lace disposed in the tensioning region, or of a portion of the tensioning lace that lies outside the housing of the tensioning element, respectively, thus is rendered so as to be able to be variably set. Additionally, the spacing from the coupling element can be variably set on account thereof, this having an influence on the transmission of force from the coupling element to the glove.

The tensioning element is preferably fastened to the hand dorsum on the glove (as an actual glove or as a hand strap), particularly preferably in the region of the wrist or up to 0.5 cm to 3 cm further outside at the fingers.

To this end, the coil mentioned above is preferably disposed in a recess of the tensioner housing, wherein the coil is preferably mounted so as to be rotatable in the recess and has an annular duct for receiving the tensioning lace. The tensioning wheel is preferably rotatable relative to the housing, wherein the tensioning wheel is suitable for driving the coil in the recess. Rotation of the tensioning wheel in a first direction, for example in the tensioning direction, relative to the housing drives the coil so as to wind the tensioning lace or a cable onto the coil, and to on account thereof tighten or tension, respectively, the lacing system. The system in this direction preferably possesses a return stop (freewheeling only in one direction). A rotation of the tensioning wheel in a second direction, or the relaxing direction, respectively, which is counter to the first direction, drives the coil so as to gradually release the tensioning lace or the cable from the coil and to on account thereof gradually loosen or relax the lacing system, either in steps or in a continuous manner. A specific releasing force has preferably to be overcome in order for releasing to be possible in this direction.

The tensioning element preferably also has a locking and unlocking mechanism which prevents involuntary tensioning or relaxing, respectively. The relaxing herein can also be specified in such a manner that an only brief rotation of the tensioning wheel in the second direction, or the activation of a trigger means preferably disposed on the tensioning element, or pulling or pushing the tensioning wheel per se, enables partial relaxing or complete relaxing and thus the tensioning lace rolled up on the coil to be completely released immediately in one go.

The tensioning region on the glove upper side is preferably disposed only to one side of the tensioning element, preferably between the tensioning element and the beginning of the thumb covering. The tensioning region is in particular formed by a variable region which is disposed only to one side of the tensioning element and which is spanned by the tensioning lace. The tensioning lace here, in particular emanating from the tensioning element, spans the variable region in the direction toward the thumb covering and back to the tensioning element, preferably in a V-shaped or zigzag style. However, a substantially triangular disposal of the tensioning lace is also possible, for example.

The variable region herein preferably has a width which is able to be variably set by tensioning and relaxing the tensioning lace. The spacing between the tensioning element and the coupling element is in particular able to be variably set.

For this purpose, the variable region is preferably at least in part formed from a material which is in any case flexible, preferably ribbed or pleated, and which can be compressed or squeezed, respectively, and also unfolds again once the lacing system has relaxed. Alternatively, the glove (as an actual glove or as a hand strap) according to a further preferred embodiment for selectively setting the width of the variable region can have two material portions that are spaced apart at least in a relaxed state of the tensioning lace. Said material portions on the glove upper side (in the case of the hand strap corresponding to the upper side or the hand dorsum side of the hand-holding device) by tensioning the tensioning lace can be moved toward one another in such a manner that the spacing between the two material portions is decreased at least in regions. Conversely, the spacing is increased again to at most the original width thereof when the lacing system is relaxed again.

According to one particularly advantageous embodiment, the tensioning lace, between a first end, fastened to or in the tensioning element (or introduced into the duct of the tensioning element), respectively, and on a second end, preferably fastened to or in the tensioning element, has at least one first deflection portion on the glove upper side (in the case of the hand strap corresponding to the upper side or the hand dorsum side of the hand-holding device). However, it is also conceivable that only one end of the tensioning lace is fastened in the tensioning element. The tensioning lace changes direction in said first deflection portion. The deflection portion is preferably guided through a first guide strap which is configured for receiving the tensioning lace. The tensioning lace preferably has a total of at least three such deflection portions, wherein said deflection portions, preferably each of said deflection portions, are/is in each case guided through one guide strap. Alternatively, the tensioning lace can also be guided through a simple recess/opening of the external skin of the glove, or of a material portion fastened thereto. In an alternative, substantially triangular, disposal of the tensioning lace, the tensioning lace runs out of the tensioning element, traverses the variable region or the tensioning region, respectively, then by way of a deflection runs through a first guide strap in the region of the beginning of the thumb covering, or in the case of a hand strap in the region of the beginning of the exit opening for the thumb, then runs through a further guide strap below the first guide strap, and then back into the tensioning element, wherein the tensioning lace emanating from the tensioning element spans the variable region only twice.

Particularly preferable is a construction mode in which the tensioning element on the hand dorsum is fastened externally on the glove (as an actual glove or as a hand strap), preferably in the region of the wrist or so as to be offset somewhat further toward the fingers. It is furthermore preferable when the tensioning lace does not encompass the wrist in an encircling manner and also does not encompass the hand in an encircling manner.

Particularly preferable is a construction mode in which the tensioning lace emanating from the tensioning element is first guided to a first guide strap which either is connected directly to the coupling element in said saddle region, or is connected to the coupling element by way of a non-elastic material strip. The tensioning lace subsequently runs back to a further guide strap which is disposed directly at the tensioning element. This further guide strap either is connected directly to the tensioning element or is again connected to the tensioning element by way of a non-elastic material strip or connected to the material region on which the tensioning element is in turn fastened. Having passed said further guide strap, the tensioning lace runs back into the same thumb-side direction, but now to a third guide strap which is disposed below the beginning of the thumb and in the region of the wrist. Having passed said third guide strap, the tensioning lace preferably runs back to the tensioning element so as to be introduced into the latter there, and to be set in terms of length by way of said tensioning element.

The tensioning lace preferably runs through the three guide straps so as to be ideally unimpeded and with little friction.

In other words, in this preferred guiding of the tensioning lace and this disposal of the tensioning element, the tensioning lace in terms of the longitudinal axis of the glove runs in each case only substantially on the hand dorsum side and from the tensioning element only on the thumb side. An optimum setting of the substantial regions of the glove, or of the hand strap, respectively, specifically the ideally tight coupling of the coupling element and the positive fastening around the wrist, is caused on account of the double deflection on the guide strap in the saddle region and the third guide strap in the wrist region. The third guide strap is preferably fastened to a woven fabric region which encompasses the wrist and is again connected directly or indirectly to that region on which the tensioning element is fastened. The fastening of this type leads to a particular self-regulating setting; if tension is exerted on the coupling element, tension is thus automatically also triggered on the tensioning lace, said fastening mechanism thus being increasingly tightened around the wrist also by way of the third guide strap. It is thus possible for a position which is just comfortable to be set without excessive tension and without interrupting the flow of blood, but for the system to be automatically contracted around the wrist when the glove, or the hand-holding device, respectively, is stressed, or when tension is exerted by way of the coupling element, respectively.

In principle however, it would also be possible for the lace of the lacing system, instead of being guided through a guide strap, to be guided directly through a recess of the upper material of the glove (as an actual glove or as a hand strap), or through a recess or an eyelet in a reinforcement strip, or, in the case of a cover tab, through a recess of the cover tab, respectively.

In one particularly preferred embodiment, the lacing system is coupled either directly or indirectly to the coupling element by way of at least one material band. The material band, which preferably has little elongation or is even free of elongation, herein can be designed in the form of at least one reinforcement strip, preferably from a woven textile material such as polypropylene, for example. This material band connects the saddle region to the lacing system, so to speak. A guide strap as mentioned above, for guiding through the lace, in the case of a tensioning system for guiding through the tensioning lace, is preferably fastened to said material band.

The coupling element is preferably configured as a device which is to be hooked in place from above over a hook-type device of the pole handle, or as a strap-shaped, ring-shaped, or eyelet-shaped device which is able to be pushed from above over a hook-type device of the pole handle, respectively, and is particularly preferably configured as a movable strap.

The coupling element is advantageously fastened to the glove (as an actual glove or as a hand strap) by way of at least one fastening element, in particular a fastening strip, preferably is sewn to the external side of the glove or is adhesively bonded to the glove. Said fastening element is preferably configured from a woven textile material, preferably based on plastics material, and has a preferred width of between 3 mm and 30 mm. The fastening element is preferably disposed in the saddle region between the thumb covering and the first finger covering preferably configured as an index finger covering, or in the case of a hand strap is preferably disposed in the saddle region between the exit opening for the thumb and the exit opening for the remaining fingers, respectively. The fastening element herein can also be a material portion, or a material blank, respectively, with an oval or round shape, for example. Said material portion can be formed, for example, from leather or plastics material, or optionally likewise from a woven textile material, preferably based on plastics material.

In a further preferred glove, at least one first guide strap for receiving the lace, or the tensioning lace, respectively, is fastened or molded to a first reinforcement strip. The guide strap can also be configured so as to be integral to the first reinforcement strip, that is to say that the reinforcement strip at an end which is opposite to the articulation in the saddle region is shaped so as to form a guide strap.

The first reinforcement strip can be fastened, in particular sewn, or molded to the fastening element for the coupling element. Alternatively, the first reinforcement strip can be configured so as to be integral to the fastening element for the coupling element, that is to say preferably for a movable strap, such that the coupling element is fastened directly to the glove by means of reinforcement strips, so to speak, or that the fastening element transitions to a strip-like portion which is coupled to the lacing system by way of a guide strap which is potentially fastened to said portion or is integrally molded to said portion. In such a case, the strip-like portion of the fastening element assumes the task of the first reinforcement strip.

In one further preferred embodiment the reinforcement strip at least in part overlaps with the fastening element and/or with a material portion which forms the first guide strap.

The reinforcement strip serves as a bridge element between the strap fastening in the saddle region and the tensioning system in the hand dorsum region, so to speak. On account thereof, the transmission of force from the arm, or from the hand, respectively, by way of the glove (as an actual glove or as a hand strap) on to the pole handle and thus to the pole is optimized, in particular when supported on the pole, which increases inter alia the capability to direct the pole. Conversely, the tensile force from the pole handle by way of the coupling element is also distributed to the glove. The reinforcement strip moreover reinforces in particular the region, or the regions, respectively, of the external skin of the glove which is/are stressed by tension, in that the force is distributed to the glove.

The coupling element, when said coupling element is configured as a movable strap, is advantageously configured from a flexible, that is to say preferably flexural yet nevertheless high-tensile material, preferably from a cable or a hoop, for example from woven or braided UHMWPE (for example Dyneema®) or aramid (for example Kevlar®). The movable strap substantially per se herein, that is to say in terms of the fastening position so to speak, is fastened so as to be immovable on the glove (as an actual glove or as a hand strap).

The movable strap per se however is preferably configured so as to be flexible and movable, wherein said movable strap has a sufficient inherent stiffness such that said movable strap is stabilized in a position in the space between the thumb covering and the first finger covering, or in the case of a hand strap between the exit opening for the thumb and the exit opening for the remaining fingers, respectively. On account thereof, that part of the movable strap on the glove (as an actual glove or as a hand strap) that projects or protrudes, respectively, from the glove surface (in the case of the hand strap corresponding to the surface or the hand dorsum side of the hand-holding device) is disposed substantially in a plane which in the case of an opened and extended hand of the user is defined by the thumb and index finger of said user.

The movable strap in the resting position, that is to say in a non-use position, or in the state uncoupled from the pole handle, respectively, and in particular in the absence of an effect of force, is preferably configured so as to be substantially semi-circular or semi-oval.

The movable strap is preferably a strap from a braided plastics material, in particular based on polyethylene, polyamide, polypropylene, aramid, or a combination of said materials, or the movable strap is shaped from another material capable of tensile loading.

According to one particularly preferred embodiment, the movable strap has a thickness of 1 mm to 5 mm, preferably of 2 mm to 3 mm. The movable strap herein advantageously projects by between 5 mm and 20 mm, particular preferably between 5 mm and 10 mm, beyond the saddle region between the first finger covering and the thumb covering, or in the case of a hand strap between the exit opening for the remaining fingers and the exit opening for the thumb.

The material of the movable strap in the non-projecting region, preferably by way of both ends, is fastened to the glove (as an actual glove or as a hand strap) and/or, as an intermediate layer of the glove, is adhesively bonded, sewn in, interwoven or otherwise fastened between the two material tiers of the glove at least by way of a length of 2 cm to 15 cm, particularly preferably of at least 5 cm, wherein the fastening element described above and/or the reinforcement strip described above may serve as one of said material tiers.

One further preferred embodiment, which is particularly suitable for cross-country/Nordic sports, on the glove upper side or the hand strap upper side has an external skin which in the tensioning region is interrupted in the longitudinal direction of the glove such that a gap formed. Said gap is preferably backed by an "internal skin" which forms the main body of the glove, so to speak, or which is formed by a further material layer fastened to the main body of the glove.

The external skin on the glove upper side (in the hand strap corresponding to the upper side of the hand-holding device) is thus at least in part formed by two material portions that are mutually spaced apart in the resting state, or in the relaxed state, respectively. Said two material portions can be, for example, two cover tabs which are in each case fastened on one side to the hand-holding device and which toward the center of the hand-holding device, at the upper side of the hand-holding device, bear loosely on the internal skin, that is to say are not fastened to the internal skin, or to the main body of the glove (as an actual glove or as a hand strap), i.e. in particular in the peripheral region of the mutually facing edges, or opposite edges, respectively, that are directed toward the gap. This embodiment preferably has a first cover tab which on one side is fastened to the glove and a second cover tab which is preferably fastened on one side to the glove, the gap being disposed in the longitudinal direction between said cover tabs. The lacing system in this case is configured in such a manner that the lace preferably runs back and forth in a zigzag manner between the first cover tab and the second cover tab. If the lacing system is tensioning system as described above, the tensioning element is fastened to the first cover tab and at least one first guide strap for the tensioning lace is fastened to the second cover tab. A second guide strap is preferably also fastened to the first cover tab, and a third guide strap is fastened to the second cover tab, in particular on the glove upper side, or the upper side of the hand-holding device below the first guide strap, respectively.

The internal skin can be formed from the same material as the external skin, or from another material. The two cover tabs can be formed from the same material or from dissimilar materials, and the material of at least one cover tab can be the same material as used for the internal skin, or be another material. The material of the external skin, or of the cover tabs, respectively, is preferably formed from a more stable and stronger high-tensile material than the internal skin, for example from an imitation leather, for example a composite of a textile carrier base such as, for example, a woven fabric from natural fibers, chemical fibers, or mixed fibers, and a plastics material cover layer such as polyvinylchloride, for example.

According to one further preferred embodiment, the first reinforcement strip is an integral component part of the second cover tab such that said first reinforcement strip is formed by an upper region of the second cover tab, and the second reinforcement strip alternatively or additionally is an integral component part of the second cover tab such that said second reinforcement strip is formed by a lower region of the second cover tab. This means that no separate first and/or second reinforcement strip has to be present, but that the cover tab assumes the task of the reinforcement strip, or forms the reinforcement strip, respectively, or that the cover tab functions as the first and/or the second reinforcement strip or vice versa, respectively.

A particularly preferred embodiment is characterized in that the first guide strap is fastened, preferably sewn, directly to the second cover tab in particular to the lower side of the second cover tab. One slot for passing through the first or the third guide strap, respectively, is in each case configured in the upper region as well as in the lower region of the second cover tab. The first guide strap passes through the first slot in the upper region of the second cover tab herein, and the third guide strap passes through the second slot in the lower region of the second cover tab. The second cover tab could also be divided in two such that one cover tab forms in each case one reinforcement strip and one guide strap is in each case fastened to each cover tab.

Additionally or alternatively, the second guide strap can pass through a slot of the first cover tab and be fastened, preferably sewn, directly to said first cover tab, in particular to the lower side of the first cover tab such that a separate third reinforcement strip is not required here either.

In one further preferred embodiment, the first guide strap is fastened or molded directly to the fastening strip for the movable strap such that the lacing system is coupled even more directly to the movable strap, or to the coupling mechanism for the pole handle, respectively.

A further subject matter of the invention relates to a pole handle having a coupling device, and having a glove (as an actual glove or as a hand strap) according to one of the embodiments described above which by means of a coupling element is releasably fastened or fastenable to the coupling device of the pole handle, as well as to a pole having such a pole handle and the glove which is releasably fastenable or fastened to said pole handle, respectively. The coupling device of the pole handle herein is preferably a hook-type device, and the coupling element of the glove is preferably a movable strap as described in more detail above. The movable strap is guided/pushed over the hook-type device and fixed in a self-latching manner. In order for the pole and the glove to be uncoupled, a trigger element on the pole handle is activated, on account of which the movable strap is released again. Alternatively, the movable strap can be held in a self-latching manner, counter to a spring-mounted resistance, at the base of the hook-type device and can be removed again by overcoming the sprung resistance counter to the extraction direction even without the trigger element, in a self-triggering manner, so to speak.

Alternatively, the coupling device of the pole handle can have a recess into which a coupling element which is configured substantially as a latching tongue and is fastened to the glove (as an actual glove or as a hand strap) can be introduced and releasably latched. A connection element which interacts with the coupling element of the glove and by means of an activation member which is accessible in the region of the handle head and is movable counter to a sprung mounting herein is preferably provided in a pole handle recess. The access to the pole handle recess into which the coupling element can be introduced and from which the coupling element can be extracted is preferably disposed in an approximately rectilinear alignment with an exit of the pole handle recess in the region of which the activation member is activatable. In such a case, the pole handle recess is preferably disposed in an arrangement which is at an acute angle in relation to the longitudinal axis of the pole handle, or of the pole tube connected thereto, respectively.

Further exemplary embodiments are described in the dependent claims.

BRIEF DESCRIPTION OF THE DRAWINGS

Preferred embodiments of the invention will be described hereunder by means of the drawings which serve only for an explanatory purpose and are not to be interpreted as limiting. In the drawings.

DESCRIPTION OF PREFERRED EXEMPLARY EMBODIMENTS

Figure 1:
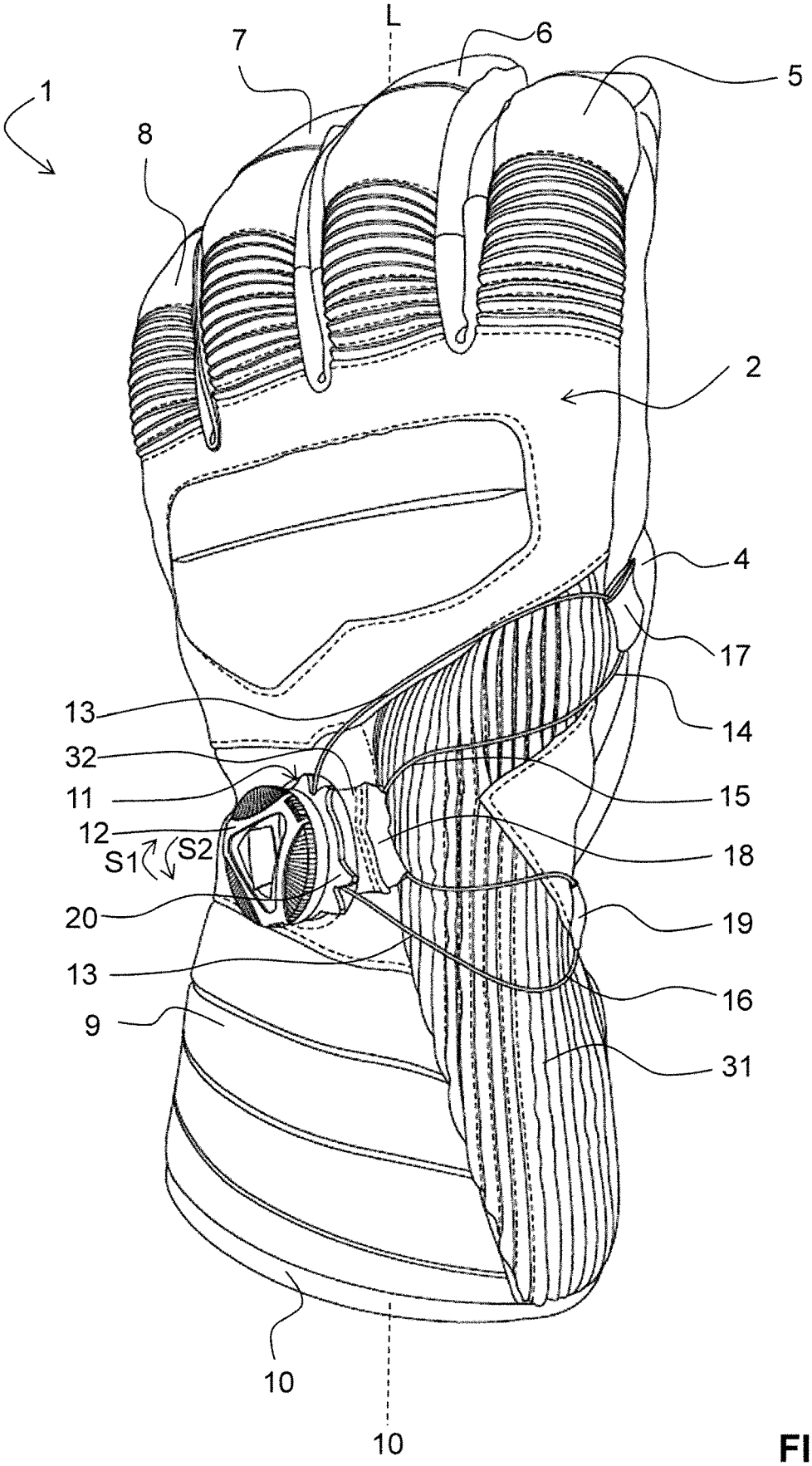
FIG. 1 shows a perspective schematic illustration of a hand-holding device in the form of a glove for the left hand of a user, according to a first preferred exemplary embodiment, preferably for the use in Alpine skiing.

A first preferred exemplary embodiment of a glove 1 according to the invention is illustrated in FIG. 1. This first preferred variant is particularly suitable for the use in alpine skiing and touring. In the sport of Alpine skiing, such thicker and padded gloves are mostly used rather than in cross-country/Nordic sports where hand straps which can be worn with or without separate gloves are alternatively also used. The illustrated glove 1 is configured as a finger glove. Said finger glove has a thumb covering 4 for receiving the thumb of the left hand of the user, and a first finger covering 5 for receiving the index finger, as well as a second finger covering 6 for receiving the middle finger, a third finger covering 7 for receiving the ring finger, and a fourth finger covering 8 for receiving the little finger.

The glove 1 which is most often formed from a plurality of textile elements and layers, has padding elements and/or reinforcement elements at various locations so as to protect the hand of the user against injury on account of impact or abrasion. The glove 1 likewise preferably has insulation material so as to prevent an ingress of cold and wet.

For the purpose of setting the width of the worn glove 1, or for adapting the size of the glove to the size of the hand of the wearer, and for preventing the glove 1 from slipping on the hand of the user, the glove 1 on the glove upper side 2 thereof, or on the back of the glove that covers the hand dorsum of the user, respectively, has a lacing system. Said lacing system is preferably disposed between a wrist seam which delimits a wrist region 9 toward the bottom, and an articulation of the finger coverings 5-8. The lacing system in the exemplary embodiment illustrated in FIGS. 1 to 4 has a tensioning lace 13 which by way of a first and a third guide strap 17, 19 is coupled to the material layer on the glove upper side 2, and at an opposite location on the glove upper side 2 by way of a second guide strap 18 is releasably coupled to a tensioning element 11. Between the first guide strap 17 and the third guide strap 19, the tensioning lace 13 in a zigzag style, so to speak, runs back in the direction of the tensioning element 11 again and said tensioning lace 13 in the region of the tensioning element 11 runs through the second guide strap 18 which is coupled to the tensioning element 11 or is coupled in the proximity of the latter. The tensioning lace 13 thus overlaps multiple times a variable region 31 of the glove 1 on the glove upper side 2, wherein said variable region 31 forms a tensioning region which runs substantially in the longitudinal direction, or along a longitudinal axis L of the glove 1, respectively. Said variable region 31 is configured so as to be able to be pleated, or compressed or squeezed, respectively. In the present exemplary embodiment of FIGS. 1 to 4, the variable region 31 is configured from a ribbed or pleated material, preferably from a textile material. The tensioning element 11 has two recesses 21, 22 for passing through the tensioning lace 13, and tensioner housing 20 to which a rotatable tensioning wheel 12 for tensioning the tensioning lace 13 is fastened. The width of the variable region 31 is decreased when tensioning the tensioning lace 13 by activating the tensioning wheel 12 in a first direction S1, or in a tensioning direction S1, respectively. The spacing between the first guide strap 17 which is disposed in the region, or in the proximity, of the saddle region 23, respectively, and through which a first deflection region 14 of the tensioning lace 13 is guided, and the second guide strap 18 which is disposed in the region of the tensioning element 11 is thus also decreased, as is the spacing between the third guide strap 19 which is disposed below the first guide strap 17 and through which a third deflection. region 16 of the tensioning lace 13 is guided, and the second guide strap 18 which is disposed in the region of the tensioning element 11. On account of the tensioning lace 13 being retracted into the tensioner housing 20 of the tensioning element 11 when rotating the tensioning wheel 12 in the tensioning direction S1, the total length of the portion of the tensioning lace 13 protruding from the tensioner housing 20 on the glove surface 2 is thus decreased. This causes a constriction of the fit, or of the width, of the worn glove 1 on the hand of the user.

When the tensioning wheel 12 is rotated in a second direction S2, counter to the tensioning direction S1, that is to say rotated in a relaxing direction S2, the tensioning lace 13 is thus again released from the tensioner housing 20 and the total length of the portion of the tensioning lace 13 protruding from the tensioner housing 20 on the glove surface 2 is increased. On account thereof, the width of the variable region 31 is increased again, as is the spacing between the second guide strap 18 which is disposed in the region, or in the proximity, of the saddle region 23, respectively, and through which a second deflection region 15 of the tensioning lace 13 is guided, and the second guide strap 18 which is disposed in the region of the tensioning element 11, as also between the third guide strap 19 which is disposed below the first guide strap 17 and through which a third deflection region 16 of the tensioning lace 13 is guided, and the second guide strap 18 which is disposed in the region of the tensioning element 11. This causes an increase in terms of the fit, or the width, respectively, of the worn glove 1 on the hand of the user.

Figure 2:
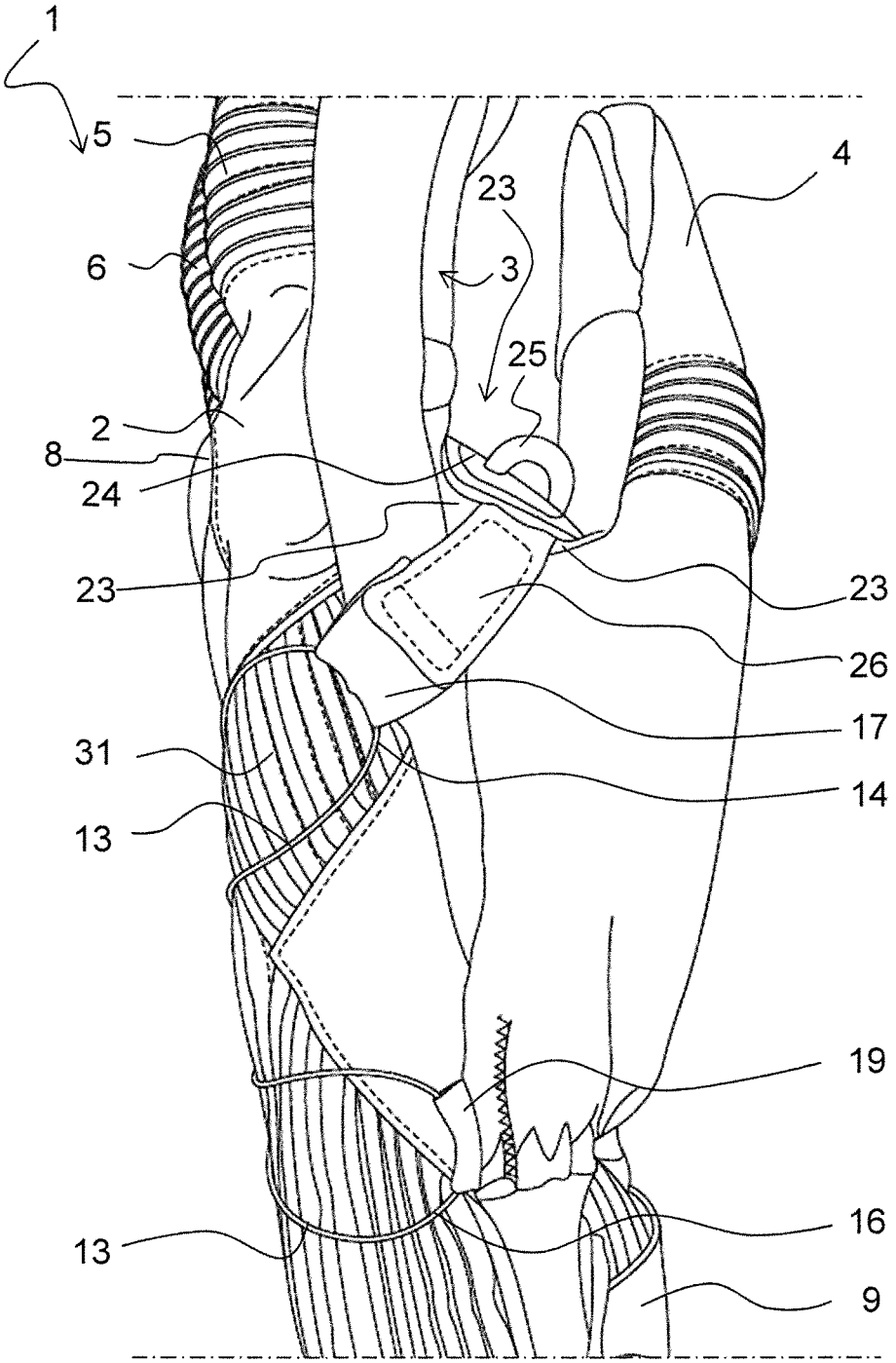
FIG. 2 shows a fragment of a lateral perspective schematic illustration of the glove of FIG. 1.

As is illustrated in FIG. 2, a saddle region 23 to which a coupling element in the form of a movable strap 25 is fastened is configured between the thumb covering 4 and the first finger covering 5. Said movable strap 25 serves for coupling the glove 1 to a ski pole (not illustrated). To this end, the ski pole in the present exemplary embodiment on the pole handle has a pin or a hook, the movable strap 25 being pushed over said pin or said hook in a preferably self-latching manner. In order for the pole and the glove 1 to be uncoupled, a trigger element on the pole handle is preferably activated on account of which the movable strap 25 is released again.

Figure 3:
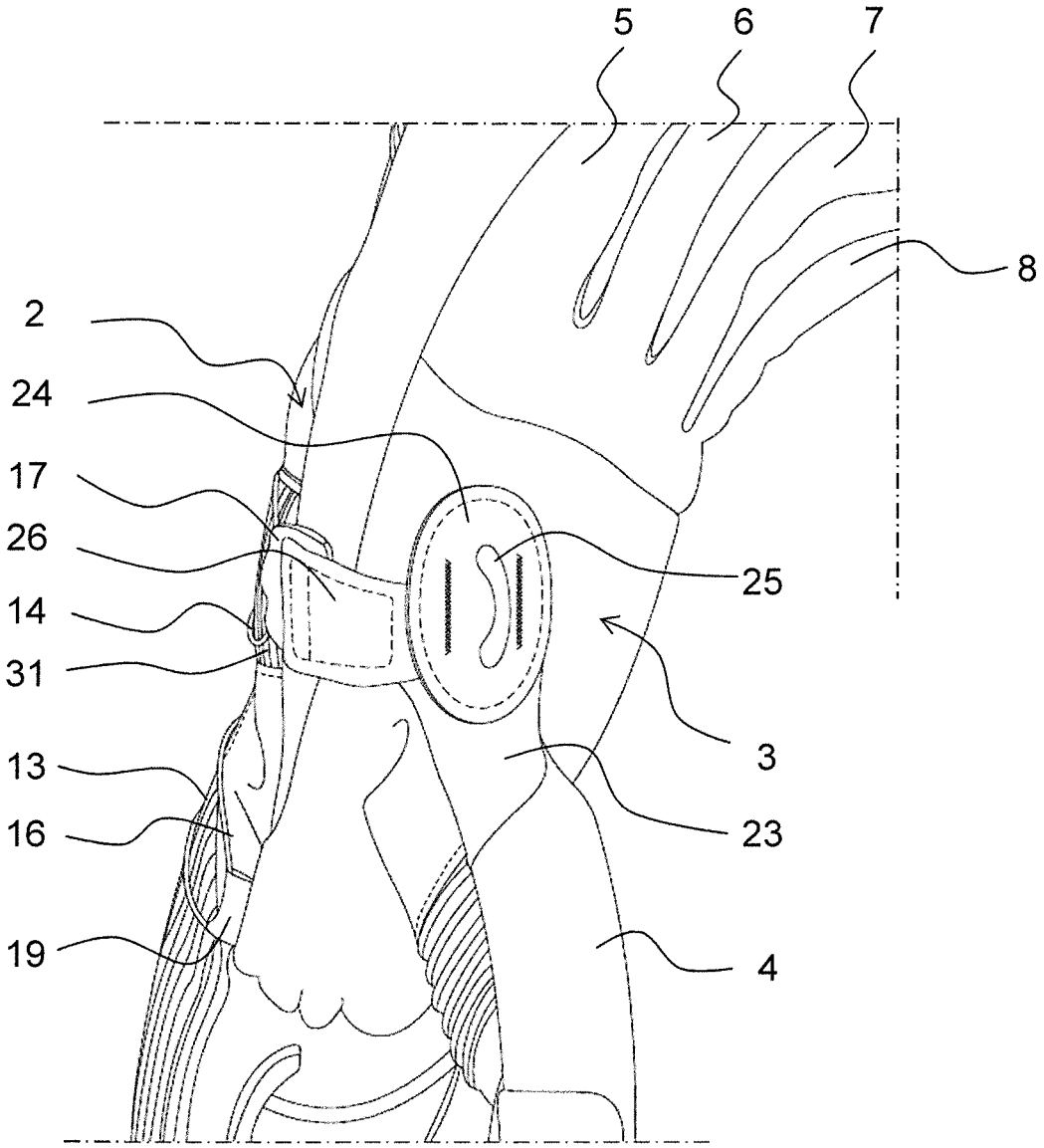
FIG. 3 shows a fragment showing a detail of the coupling region of the glove of FIG. 1 in the case of a thumb opened away from the index finger.
Figure 4:
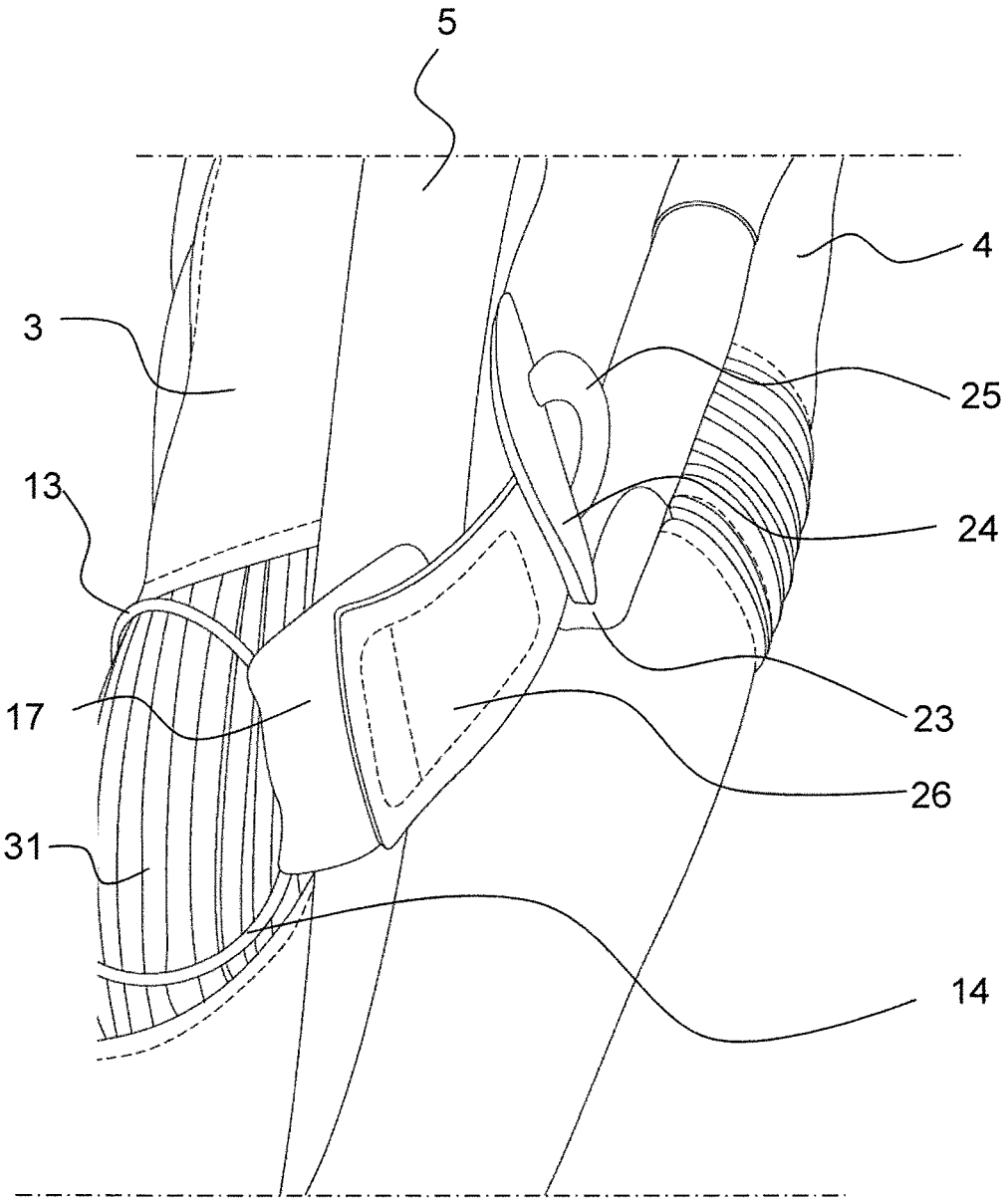
FIG. 4 shows a fragment showing a detail of the coupling region of the glove of FIG. 1 in the case of a thumb placed against the index finger.

In the present exemplary embodiment, the movable strap 25 is fastened to the material of the glove 1, or anchored therein, respectively, in the saddle region 23. A fastening element 24, or a fastening strip, respectively, is sewn on by way of the fastening location of the strap 25, said fastening element 24, or said fastening strip, respectively, having two recesses for passing through the cord forming the strap 25. The fastening element 24 in the exemplary embodiment illustrated is configured as an oval patch, as can be seen in FIG. 3.

In the present exemplary embodiment of FIGS. 1 to 4, the movable strap 25 is configured from a flexible material such as, for example, a textile cord, however has a sufficient inherent stiffness such that the strap 25 in the uncoupled state projects from the glove 1, substantially in a manner perpendicular to the glove surface in the saddle region 23. The portion of the movable strap 25 that projects from the glove 1 in the uncoupled state herein is shaped so as to be semi-circular or semi-oval, respectively. The movable strap in terms of the fastening position thereof is thus fastened so as to be substantially immovable on the glove but so as to be inherently flexible and movable. The strap by virtue of the inherent stiffness thereof is stabilized in a position in the space between the thumb covering 4 and a first finger covering 5, wherein the projecting part of the movable strap 25 on the glove 1 is disposed so as to be substantially in a plane which in the case of an opened and extended hand of the user is defined by the thumb and the index finger of said user.

A first reinforcement strip 26 is guided from the saddle region 23 toward the glove upper side 2, or toward the hand dorsum, respectively. The first reinforcement strip 26 has two ends, of which a first end is fastened, or sewn or molded, respectively, to the fastening element 24 for the strap 25, and a second end is fastened, or sewn or molded, respectively, to a first guide strap 17 through which a tensioning lace 13 of the lacing system is guided.

When the tensioning lace 13 is now tensioned, the first reinforcement strip 26 by way of the first guide strap 17 is imparted a tension, or a first force, respectively, in the direction of the tensioning element 11. However, when the movable strap 25 is coupled to a pole handle, a second force in the opposite direction engages on the movable strap 25 and thus, by way of the fastening element 24, also on the first reinforcement strip 26. The lacing system, or the tensioning system, respectively, thus acts indirectly as a force counter to the tensile force which, in the case of a coupling to a pole handle, pulls on the movable strap 25.

On account thereof, the transmission of force from the arm, or the hand, respectively, to the pole handle and thus to the pole by way of the glove 1 is optimized, in particular when supported on the pole. The first reinforcement strip 26 in the exemplary embodiment of FIGS. 1 to 4 is configured from a high-tensile material, that is to say from a material which is substantially non-elongatable or a material of very low elongation, and in the present exemplary embodiment is also reinforced by stitches. The first reinforcement strip 26 here is not fastened to the external skin, or to the upper material of the glove 1, respectively, and thus covers the external skin only loosely. On account thereof, a certain flexibility can be guaranteed when moving the hand of the user on and around the pole handle.

In the present exemplary embodiment of FIGS. 1 to 4, the second guide strap 18 is fastened or integrally molded to a third reinforcement strip 32. Said third reinforcement strip 32 here is fastened to the glove upper side 2 on one side, and optionally additionally to the tensioning element 11, preferably on the lower side of the tensioner housing 20. As is illustrated in FIG. 1, the third reinforcement strip 32 is jammed and fastened between the external skin, or the upper material of the glove 1, respectively on the glove upper side 2 and on the lower side of the tensioner housing 20. The tensioning lace 13 thus leads out of an upper first recess 21 of the tensioning element 11, or from the tensioner housing 20 thereof, respectively, so to speak, spans the variable region 31, and by way of the first deflection portion 14 is guided through a first guide strap 17. The tensioning lace 13 then leads back to a second guide strap 18 which by way of the third reinforcement band 32 is coupled indirectly to the tensioning element 11, said tensioning lace 13 by way of the second deflection portion 15 thereof there being imparted a deflection through the second guide strap 18, and in turn in a substantially opposite direction spanning the variable region 31 toward a third guide strap 19 which is disposed below the first guide strap 17 and through which the third deflection region 16 of the tensioning lace 13 is guided. The tensioning lace 13 is subsequently guided back to the tensioning element 11, or is guided into the tensioner housing 20 through a second recess 22, respectively.

Figure 5:
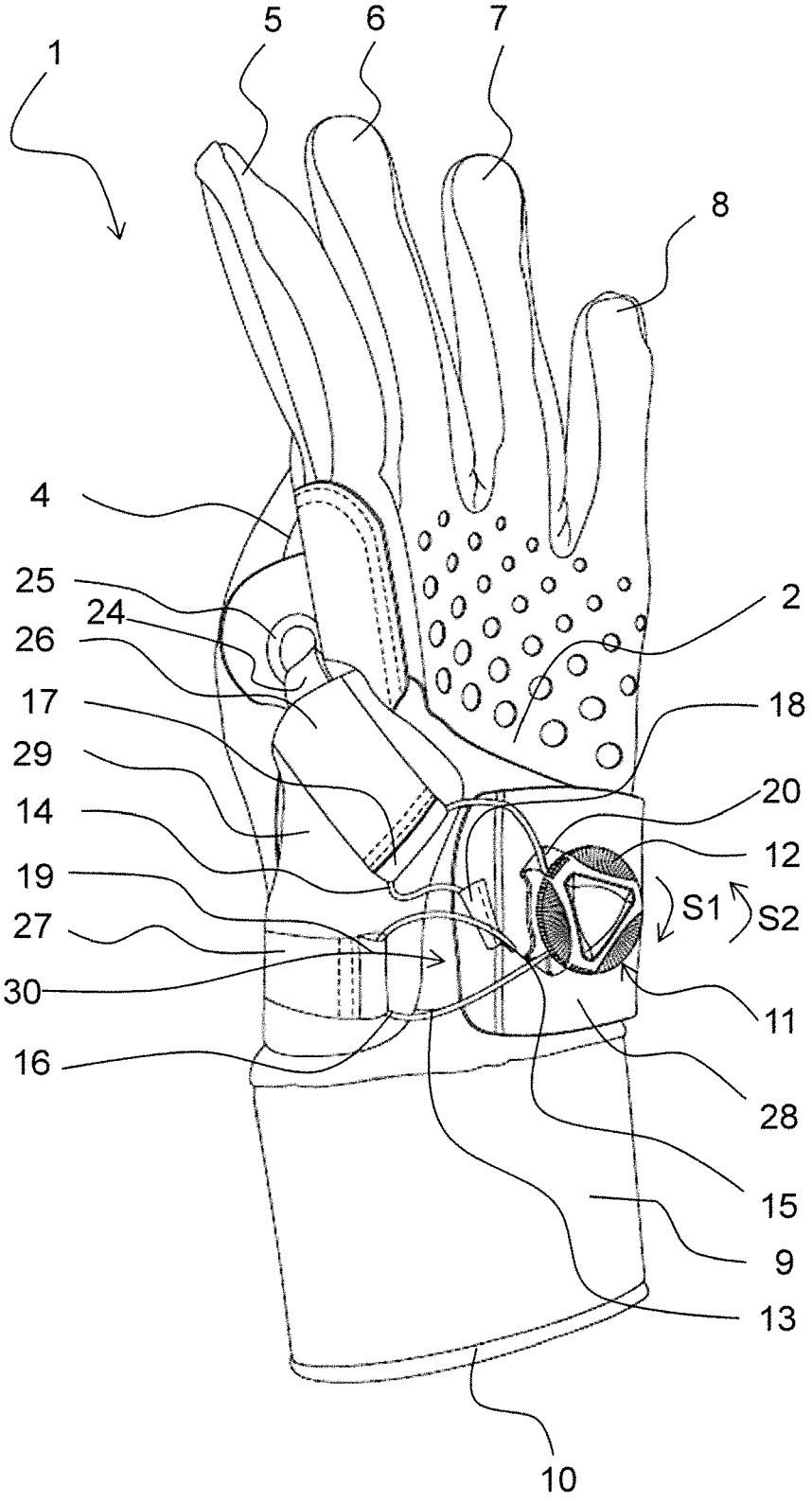
FIG. 5 shows a perspective schematic illustration of a glove for the right hand of a user, according to a second preferred exemplary embodiment, preferably for the use in cross-country/Nordic sports.

The tensioning region, or the variable region 31, respectively, can also be designed such that the upper material, or the external skin of the glove, respectively, is interrupted across the length of the tensioning region, wherein the front edges of the interrupted external skin which in this region lie opposite one another so as to be mutually exposed enclose therebetween an elongate face which is configured as an internal skin. This is the case, so to speak, in the second and the third preferred exemplary embodiment as is illustrated in FIG. 5 to 7, or 8, respectively. In those glove variants which are preferably used in cross-country/Nordic sports, the glove material is preferably thinner and more intensely ventilated as well as less padded. Independently thereof, as can be seen in FIG. 5 or 8, respectively, the glove according to the second preferred exemplary embodiment on the glove upper side 2 in the tensioning region has a first cover tab 28 to which the tensioning element 11 is fastened, and a second cover tab 29 to which the first guide strap 17 and the third guide strap 19 are fastened. An intermediate space 30, or a gap 30, respectively, which extends substantially along the longitudinal axis L of the glove 1 is thus disposed between the first cover tab 28 and the second cover tab 29. The two cover tabs 28, 29 can thus be considered as a longitudinally split external skin, and the material underpinning the intermediate space 30, or the gap, respectively, can be considered as an internal skin which optionally at least in part at the same time also serves as the upper material for the thumb covering 4 and the finger coverings 5-8, as well as optionally forms the internal side of the glove that covers the palm of the user's hand. The internal skin can likewise also form the entire face on the upper side 2 of the glove, said face in this instance being at least in part covered by the external skin, or by the two cover tabs 28, 29.

When tensioning the lacing system, or the tensioning system, respectively, the mutually opposite, or mutually facing two edges 34, 35, respectively, of the two cover tabs 28, 29 that define the intermediate space are moved toward one another. On account thereof, the intermediate space 30 is closed, and depending on the degree of tension the two cover tabs 28, 29 may even partially overlap in the region of the mutually facing edges 34, 35 of said cover tabs 28, 29.

Figure 6:
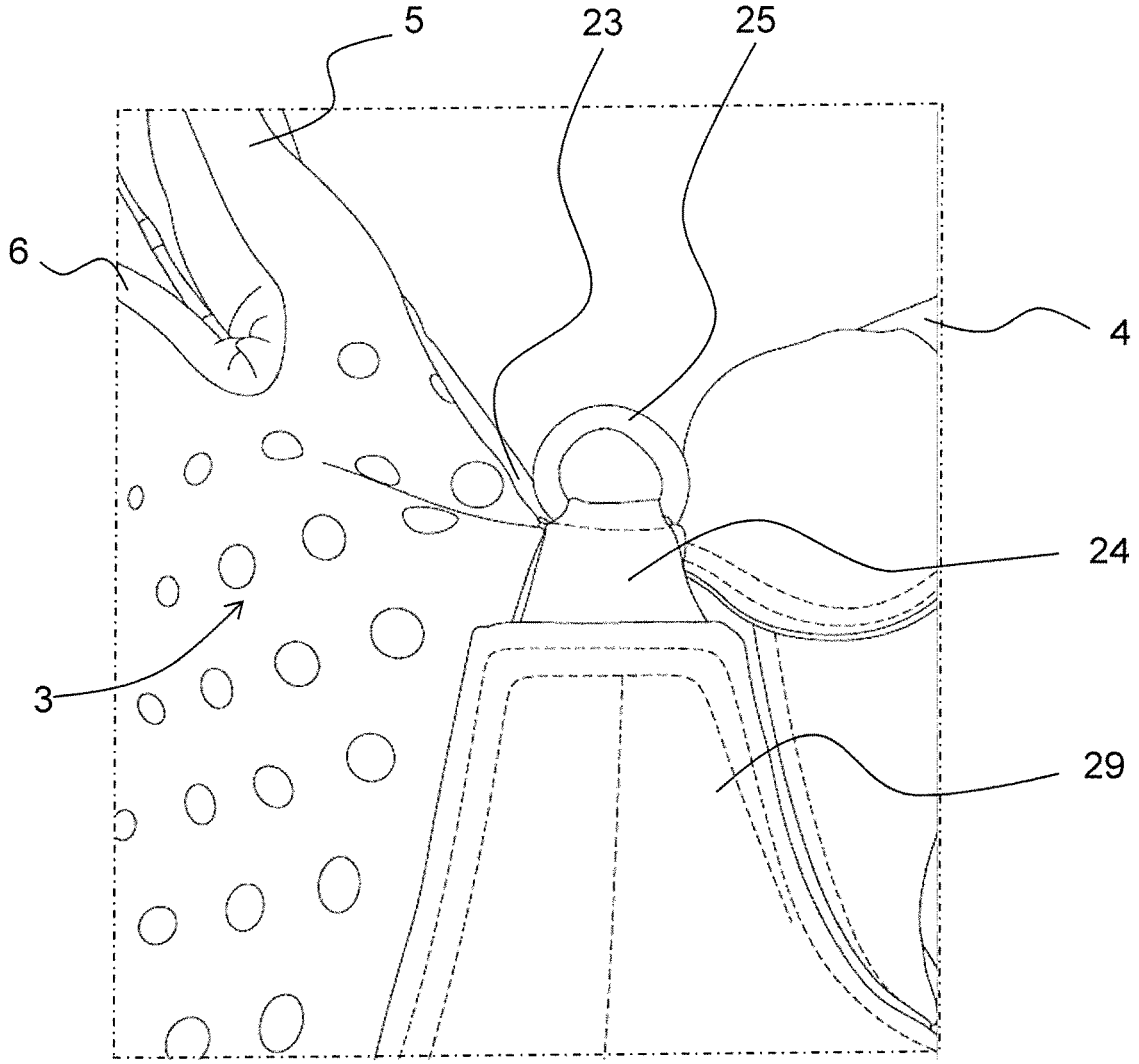
FIG. 6 shows a fragment showing a detail of the coupling region of the glove of FIG. 5 with a view toward the glove internal side, or the palm of the hand, respectively, and in the case of a thumb opened away from the index finger.
Figure 7:
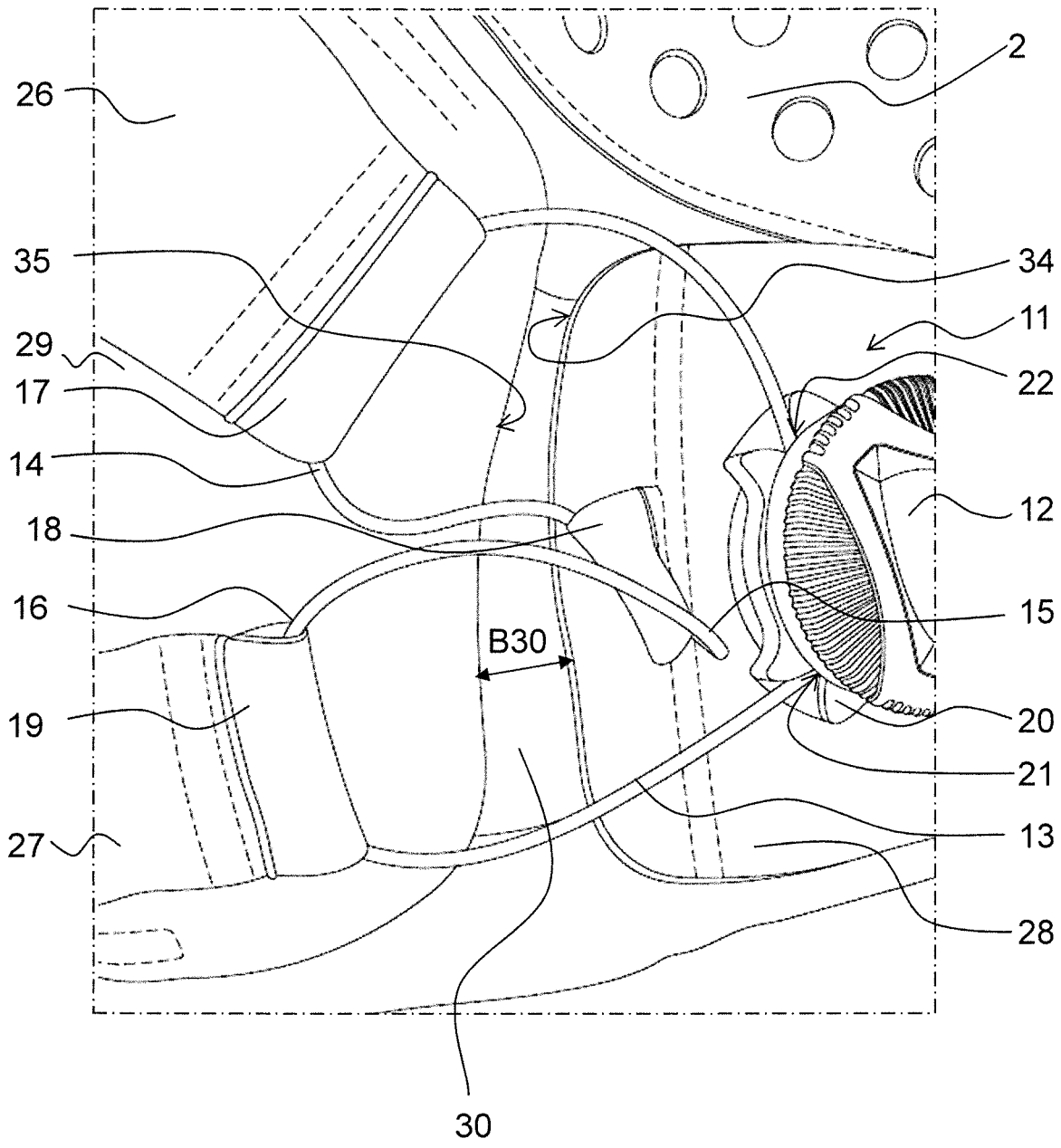
FIG. 7 shows a fragment showing a detail of the lacing system of the glove of FIG. 5.
Figure 8:
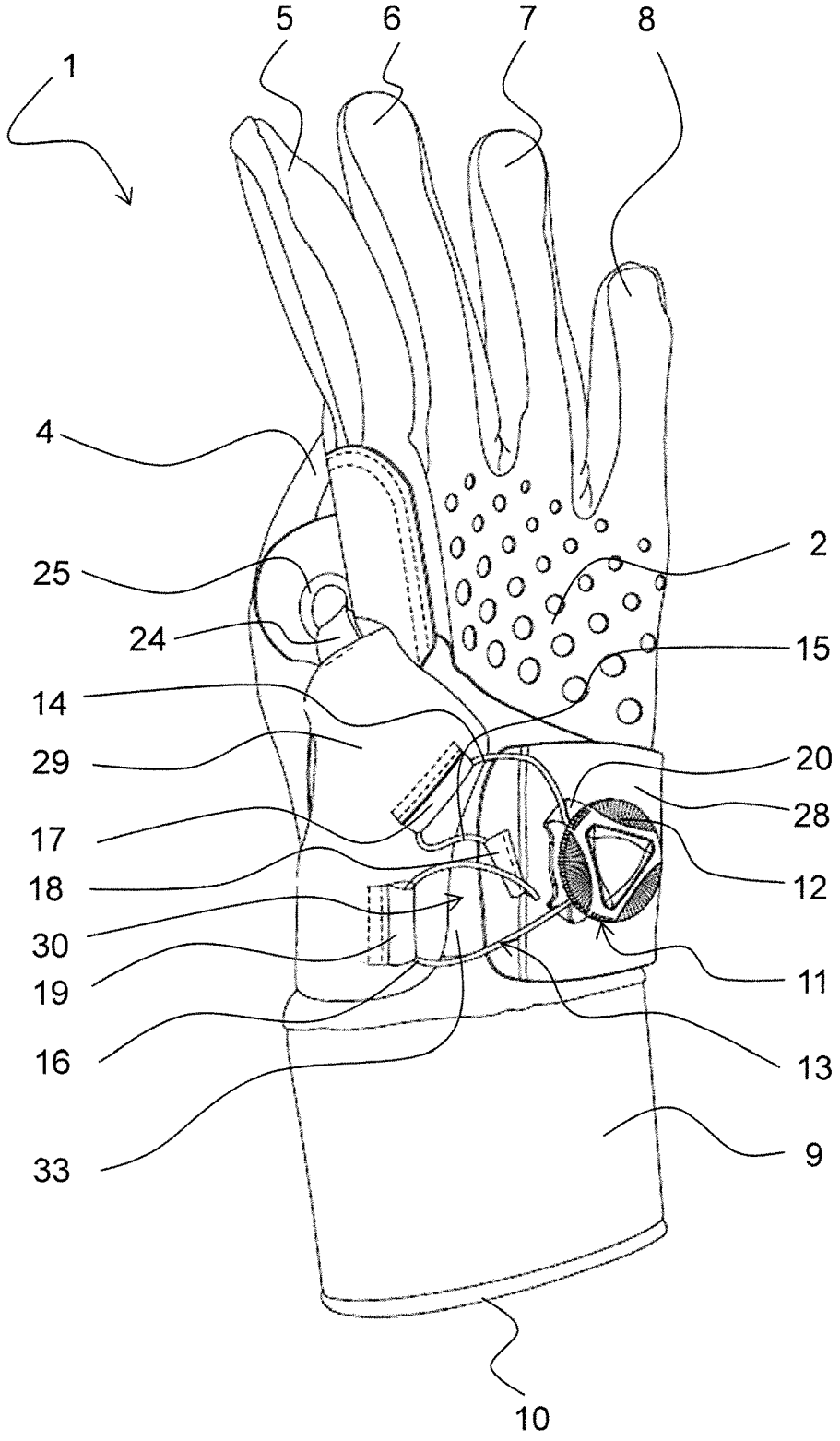
FIG. 8 shows a perspective schematic illustration of a glove for the right hand of a user, according to a third preferred exemplary embodiment, likewise preferably for the use in cross-country/Nordic sports.

In the exemplary embodiment illustrated of FIGS. 5 to 7, a first reinforcement strip 26 and a second reinforcement strip 27 are fastened or sewn, respectively, to the second cover tab 29. The first guide tab 17 here is fastened to the first reinforcement strip 26, and the third guide tab 19 here is fastened to the second reinforcement strip 27. The fastening of the guide straps 17, 19 on the glove 1 here thus takes place indirectly, that is to say by way of in each case one reinforcement strip 26, 27. As opposed to the first exemplary embodiment of FIGS. 1 to 4, no third reinforcement strip 32 is present here on the first cover tab 28, since the second guide tab 18 here is fastened directly to the first cover tab 28.

In contrast to the second exemplary embodiment, the first guide strap 17 and the third guide strap 19 in the exemplary embodiment of FIG. 8 are fastened directly to the second cover tab 29, and the second guide strap 18 is also fastened or sewn, respectively, to the first cover tab 28. In comparison to the first exemplary embodiment of FIGS. 1 to 4, the first cover tab 29 in the second and the third exemplary embodiment of FIG. 5 and FIG. 8, respectively, functions as a third reinforcement strip 32, and the second cover tab 29 in the second exemplary embodiment of FIG. 5 functions as a first and at the same time also as a second reinforcement strip, or the second cover tab 29 simultaneously forms the first and the second reinforcement strip 26, 27 of the exemplary embodiment of FIGS. 5 to 7, respectively. It could also be said that the cover tabs 28, 29 here replace the reinforcement strips 26, 27, 32, so to speak. One slot is in each case configured in the upper as well as in the lower region of the second cover tab 29 in these cases. The first guide strap 17 herein passes through the first slot in the upper region of the second cover tab 29, and the third guide strap 19 passes through the second slot in the lower region of the second cover tab 29. In the second exemplary embodiment of FIG. 5 as well as in the third exemplary embodiment of FIG. 8 the second guide strap 18 likewise passes through a slot of the first cover tab 28 and is fastened or sewn, respectively, to the latter such that a separate third reinforcement strip 32 is not necessary here either.

Figure 9:
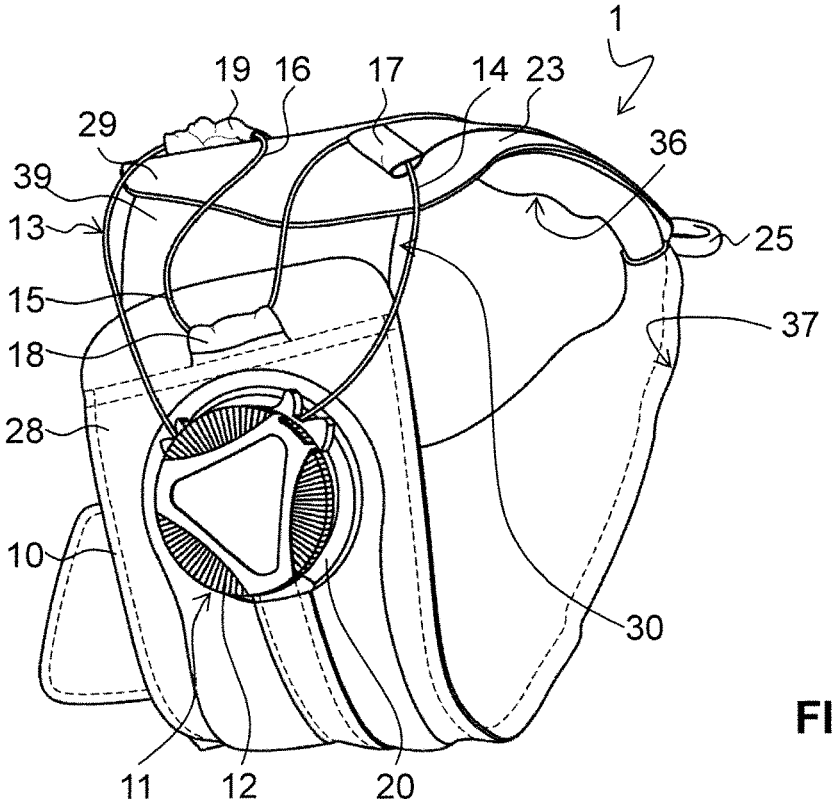
FIG. 9 shows a perspective schematic illustration of a glove in the form of a hand strap according to a fourth preferred exemplary embodiment, for a right hand of a user, preferably for the use in trekking or Nordic walking, with a view toward the tensioning element.
Figure 10:
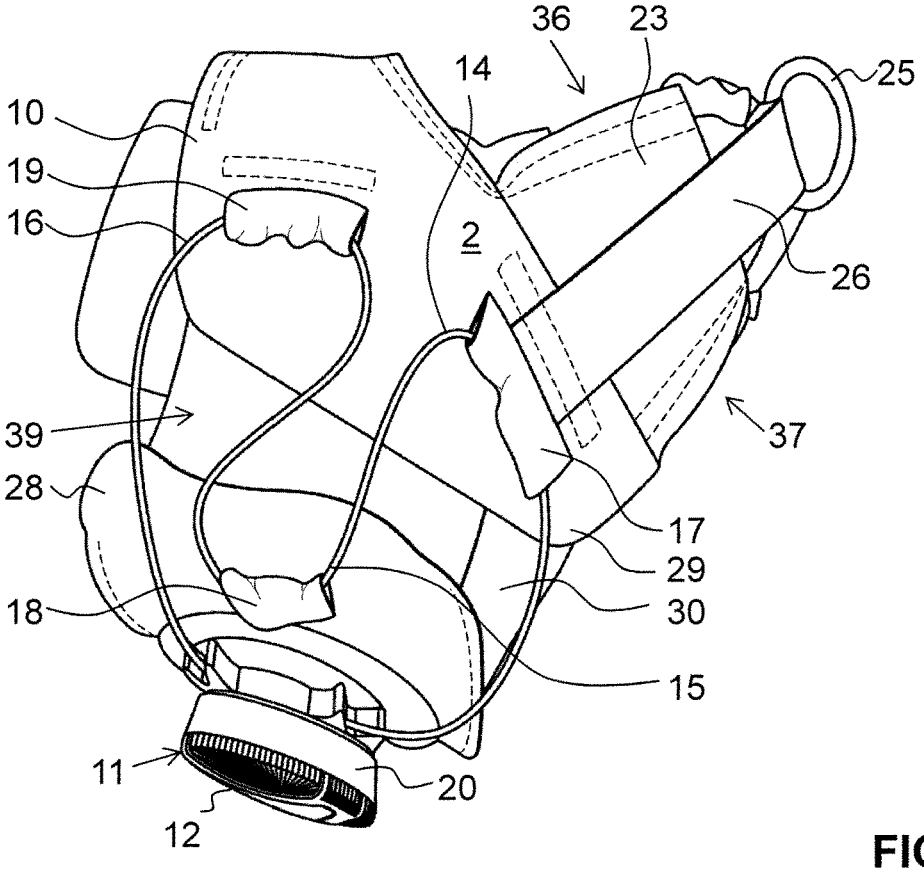
FIG. 10 shows a perspective schematic illustration of the glove strap of FIG. 9, with a view toward the upper side of the hand strap.

An exemplary embodiment of a hand strap which is in each case likewise equipped with one tensioning system for setting the width of the worn glove and can be fastened to the hand of the user is illustrated in FIGS. 9 to 10. The illustrated hand strap is suitable for being worn on the right hand of the user. The hand strap 1 herein has three openings, specifically in each case one entry opening for the wrist, and in each case one first exit opening 36 for the thumb of the user and a second exit opening 37 for the remaining fingers of the user. The saddle region 23 to which the coupling element 25 for coupling the hand strap to the pole handle is fastened is disposed between the first exit opening 36 and the second exit opening. The coupling element 25 in the exemplary embodiment of FIGS. 9 and 10 is configured as a movable eyelet which by means of a reinforcement strip 26 is fastened directly to the hand strap. The reinforcement strip 26 here thus simultaneously serves as a fastening strip. Alternatively however, the coupling element 25 can also be fastened to the hand strap by means of an additional fastening strip 24 which is sewn to the reinforcement strip 26. In the exemplary embodiment of FIGS. 9 and 10, the second guide strap 18 is fastened to the first cover tab 28 in the proximity of the tensioning element 11. Alternatively, the second guide strap 18 in the exemplary embodiment of FIG. 11 can also be fixed directly on the tensioning element, or below the tensioning element, respectively. In the hand strap according to FIGS. 9 and 10, the intermediate space, or the gap 30, respectively, between the first cover tab 28 and the second cover tab 29 is backed by a material layer, in a manner similar to that in the glove of FIG. 5 or FIG. 8. While said material layer herein in the glove of FIG. 5 or FIG. 8 is a portion of an internal skin 33, so to speak, the hand strap according to FIGS. 9 and 10 is an elastic material portion 39, for example a wide elastic band or a material portion from neoprene. The flexible material portion 39 herein is preferably fastened to the lower side of the two cover tabs. Alternatively however, the intermediate space, or the gap 30, respectively, may also not be backed by a further material layer, or the hand strap can also be configured so as to be open in the region of the intermediate space 30.

LIST OF REFERENCE SIGNS

1 Hand-holding device, glove/hand strap
2 Glove upper side, upper side, back of 1
3 Glove lower side, lower side of 1
4 Thumb covering
5 First finger covering, index finger covering
6 Second finger covering, middle finger covering
7 Third finger covering, ring finger covering
8 Fourth finger covering, little finger covering
9 Wrist region of 1
10 Wrist seam of 1
11 Tensioning element
12 Tensioning wheel
13 Tensioning lace, tensioning cable
14 First deflection portion of 13
15 Second deflection portion of 13
16 Third deflection portion of 13
17 First guide strap for 14
18 Second guide strap for 15
19 Third guide strap for 16
20 Tensioner housing
21 First recess for 13 on 20

22 Second recess for 13 on 20
23 Saddle region between 4,5 or between 36, 37, respectively
24 Fastening strip for 25, fastening element
25 Movable strap, coupling element
26 First reinforcement strip
27 Second reinforcement strip
28 First cover tab
29 Second cover tab
30 Intermediate space, gap between 28, 29
31 Variable region
32 Third reinforcement strip
33 Internal skin
34 Edge of 28
35 Edge of 29
36 First exit opening for the thumb
37 Second exit opening for the remaining fingers
38 Fourth reinforcement strip
39 Elastic material portion
B30 Width of 30
L Longitudinal axis of 1
S1 First rotation direction, tensioning direction of 12
S2 Second rotation direction, relaxing direction of 12

The invention claimed is:

1. A glove having a thumb covering and at least a first finger covering, said glove in a saddle region between the thumb covering and the first finger covering possessing a coupling element which is configured for releasably fastening the glove to a coupling device of a pole handle, wherein the glove has a lacing system for selectively setting a width of the worn glove;

wherein the lacing system is located on a glove upper side, wherein the lacing system has a tensioning element with a housing, a tensioning wheel and a coil received in said housing and wherein the lacing system furthermore has a tensioning lace which is guided through at least one first guide strap, wherein the tensioning lace, by rotation of said tensioning wheel in a tensioning direction, tensions the tensioning lace in a lace tensioning direction in a tensioning region and the width of the glove is thus decreased;

wherein the tensioning lace by rotation of said tensioning wheel in a relaxing direction is relaxed or released in a lace relaxing direction counter to the lace tensioning direction and the width of the glove is thus increased;

wherein the tensioning region on the glove upper side is located only to one side of the tensioning element;

wherein the tensioning region includes a variable region which is located only to one side of the tensioning element and which is spanned by the tensioning lace;

wherein said tensioning lace emanates from the tensioning element and spans the variable region by travelling in a direction toward the thumb covering and travelling back to the tensioning element;

wherein the tensioning lace, between a first end which is fastened to the tensioning element and a second end which is fastened to the tensioning element, in said at least one first guide strap has at least one first deflection portion, and wherein the lacing system is coupled to the coupling element by way of at least one material band, in the form of at least one reinforcement strip and by way of said at least one first guide strap for guiding through said tensioning lace, wherein an external skin on the glove upper side is interrupted in the tensioning region, such that a gap is formed, and wherein the gap is backed by an internal skin.

2. The glove as claimed in claim 1, wherein the variable region is at least in part configured from a ribbed or pleated material which can be compressed, and/or wherein for selectively setting the width of the variable region two material portions on the glove upper side that in a relaxed state of the tensioning lace are mutually spaced apart by a gap can be moved toward one another in such a manner that a width of the gap between the two material portions is decreased, or the gap is eliminated by overlapping the two material portions.

3. The glove as claimed in claim 1, wherein the coupling element is fastened to the glove by way of at least one fastening strip.

4. The glove as claimed in claim 3, wherein said at least one first guide strap is fastened or molded to a first reinforcement strip, wherein the first reinforcement strip is fastened or molded to the at least one fastening strip for the coupling element.

5. The glove as claimed in claim 4, wherein the first reinforcement strip at least in part overlaps with the at least one fastening strip and/or with a material portion which forms the at least one first guide strap.

6. The glove as claimed in claim 3, wherein said at least one first guide strap is fastened or molded to a first reinforcement strip, wherein the first reinforcement strip is fastened or molded to the at least one fastening strip for the coupling element, wherein the first reinforcement strip is sewn to the at least one first guide strap.

7. The glove as claimed in claim 1, wherein the coupling element is configured as a movable strap, and wherein the movable strap is fastened so as to be substantially immovable on the glove, wherein the movable strap is however configured so as to be inherently flexible and movable, wherein the movable strap has a sufficient inherent stiffness such that said movable strap is stabilized in a position in the space between the thumb covering and the first finger covering such that the projecting part of the movable strap on the glove is disposed substantially in a plane which in the case of an opened and extended hand of the user is defined by the thumb and the index finger of said user.

8. The glove as claimed in claim 7, wherein the movable strap in the resting position is configured so as to be substantially semi-circular or semi-oval, and/or wherein the movable strap is a strap from a braided plastics material, and/or wherein the movable strap has a thickness of 1 mm to 5 mm.

9. The glove as claimed in claim 7, wherein the movable strap in the resting position is configured so as to be substantially semi-circular or semi-oval, and/or wherein the movable strap is a strap from a braided plastics material, based on polyethylene, polyamide, polypropylene, aramid, or a combination of said materials, and/or wherein the movable strap has a thickness of 1 mm to 5 mm, or of 2 mm to 3 mm, wherein the movable strap projects by between 5 mm and 20 mm, or between 5 mm and 10 mm, beyond a saddle region of the glove between the first finger covering and the thumb covering.

10. The glove as claimed in claim 1, wherein the coupling element is configured as a latching tongue which is fastenable in a corresponding recess in a pole handle.

11. The glove as claimed in claim 1, wherein the glove is configured as a hand strap which is fastenable to the hand of the user and which as the thumb covering has an exit opening for the thumb, and as said at least one finger covering has an exit opening for the at least one finger or for all remaining four fingers, wherein the saddle region is disposed between the first exit opening for the thumb and the second exit opening for the remaining fingers.

12. The glove as claimed in claim 1, further comprising a pole and a coupling device of the pole handle, wherein said glove is releasably fastened or fastenable to the coupling device.

13. The glove as claimed in claim 1, wherein the variable region has a width which can be variably set by tensioning and relaxing the tensioning lace, wherein the spacing between the tensioning element and the coupling element can be variably set.

14. The glove as claimed in claim 1, wherein the tensioning lace has a total of at least three deflection portions, wherein each of the deflection portions is in each case guided through said at least one first guide strap and further guide straps, respectively.

15. The glove as claimed in claim 1, wherein the coupling element is fastened to the glove by way of at least one fastening strip from a woven textile material.

16. The glove as claimed in claim 1, wherein the coupling element is fastened to the glove by way of at least one fastening strip having a width of between 3 mm and 30 mm that is sewn to the external side of the glove or is adhesively bonded to the glove, and wherein the fastening strip is disposed in said saddle region between the thumb covering and an index finger covering finger covering.

17. The glove as claimed in claim 1, wherein the coupling element is a movable strap in a form of a cable or a hoop or a flexible plastics material lace, and the movable strap is fastened so as to be substantially immovable on the glove, wherein the movable strap is however configured so as to be inherently flexible and movable, wherein the movable strap has a sufficient inherent stiffness such that said movable strap is stabilized in a position in the space between the thumb covering and the first finger covering such that the projecting part of the movable strap on the glove is disposed substantially in a plane which in the case of an opened and extended hand of the user is defined by the thumb and the index finger of said user.

18. The glove as claimed in claim 1, wherein the coupling element is configured as a latching tongue which is fastenable, in a self-latching manner, in a corresponding recess in a pole handle.

19. A glove having a thumb covering and at least a first finger covering, said glove in a saddle region between the thumb covering and the first finger covering possessing a coupling element which is configured for releasably fastening the glove to a coupling device of a pole handle, wherein the glove has a lacing system for selectively setting a width of the worn glove;

wherein the lacing system is located on a glove upper side, wherein the lacing system has a tensioning element with a housing, a tensioning wheel and a coil received in said housing and wherein the lacing system furthermore has a tensioning lace which is guided through at least one first guide strap, wherein the tensioning lace, by rotation of said tensioning wheel in a tensioning direction, tensions the tensioning lace in a lace tensioning direction in a tensioning region and the width of the glove is thus decreased;

wherein the tensioning lace by rotation of said tensioning wheel in a relaxing direction is relaxed or released in a lace relaxing direction counter to the lace tensioning direction and the width of the glove is thus increased;

wherein the tensioning region on the glove upper side is located only to one side of the tensioning element;

wherein the tensioning region includes a variable region which is located only to one side of the tensioning element and which is spanned by the tensioning lace;

wherein said tensioning lace emanates from the tensioning element and spans the variable region by travelling in a direction toward the thumb covering and travelling back to the tensioning element;

wherein the tensioning lace, between a first end which is fastened to the tensioning element and a second end which is fastened to the tensioning element, in said at least one first guide strap has at least one first deflection portion, and wherein the lacing system is coupled to the coupling element by way of at least one material band, in the form of at least one reinforcement strip and by way of said at least one first guide strap for guiding through said tensioning lace, wherein an external skin on the glove upper side is interrupted in the tensioning region, in the longitudinal direction substantially along a longitudinal axis of the glove, such that a gap is formed, and wherein the gap is backed by an internal skin, wherein the external skin on the glove upper side at least in part is formed by two mutually spaced apart material portions, by a first cover tab which is fastened to the glove on one side, and a second cover tab which is fastened to the glove on one side, the gap being disposed in the longitudinal direction between said two mutually spaced apart material portions, and wherein the tensioning element as well as a second guide strap are fastened to the first cover tab, and the at least one first guide strap for the tensioning lace is fastened to the second cover tab, wherein the at least one first guide strap is fastened or sewn, directly to the second cover tab, and wherein the second guide strap is fastened, or sewn, directly to the second first cover tab.

* * * * *